US008920072B2

(12) United States Patent
Humphries et al.

(10) Patent No.: US 8,920,072 B2
(45) Date of Patent: Dec. 30, 2014

(54) DRAINAGE CHANNELS AND METHODS FOR MAKING DRAINAGE CHANNELS

(71) Applicant: ACO Polymer Products, Inc., Chardon, OH (US)

(72) Inventors: Derek Humphries, Apache Junction, AZ (US); James Allen McConnell, Montville, OH (US)

(73) Assignee: ACO Polymer Products, Inc., Chardon, OH (US)

( * ) Notice: Subject to any disclaimer, the term of this patent is extended or adjusted under 35 U.S.C. 154(b) by 0 days.

(21) Appl. No.: 13/656,155

(22) Filed: Oct. 19, 2012

(65) Prior Publication Data

US 2014/0110007 A1 Apr. 24, 2014

(51) Int. Cl.
*E01F 5/00* (2006.01)

(52) U.S. Cl.
USPC ..... 405/118; 405/36; 405/80; 405/116; 404/2; 404/4; 404/25; 404/26; 264/31; 264/35

(58) Field of Classification Search
CPC ..... E03F 3/046; E03F 5/06; E03F 2005/065; E03F 2005/063; E01C 11/227
USPC ..... 405/36, 52, 80, 116–119, 122; 264/31, 264/35; 404/2–4, 25, 26; 411/349, 535, 411/536, 549, 553; 210/163, 164; 292/73, 292/256, 260; 52/19, 20
See application file for complete search history.

(56) References Cited

U.S. PATENT DOCUMENTS

| | | | | |
|---|---|---|---|---|
| 4,699,544 | A * | 10/1987 | Karbstein | 405/118 |
| RE33,439 | E | 11/1990 | Thomann et al. | |
| 5,106,231 | A * | 4/1992 | Thomann | 405/119 |
| 5,468,096 | A | 11/1995 | Sauerwein et al. | |
| 5,564,860 | A | 10/1996 | Amann | |
| 6,170,796 | B1 * | 1/2001 | Gunter | 249/144 |
| 6,793,439 | B1 | 9/2004 | Arm et al. | |
| 7,059,804 | B2 * | 6/2006 | Sieber et al. | 405/118 |

* cited by examiner

*Primary Examiner* — Benjamin Fiorello

*Assistant Examiner* — Carib Oquendo

(74) *Attorney, Agent, or Firm* — Pearne & Gordon LLP

(57) ABSTRACT

A drainage channel includes a first sidewall provided with a first rail member extending along a longitudinal axis of the drainage channel. A second sidewall extends along the longitudinal axis of the drainage channel with the first and second sidewalls at least partially defining an interior area of the drainage channel. A first locking insert is at least partially positioned within a first rail opening of the first rail member, with the first locking insert including a first insert opening. Further examples include methods of making a drainage channel.

20 Claims, 13 Drawing Sheets

DRAINAGE CHANNELS AND METHODS FOR MAKING DRAINAGE CHANNELS

FIELD

The invention relates to drainage channels and methods for making drainage channels and, more particularly, drainage channels and methods for making drainage channels with a first rail member and a first locking insert.

BACKGROUND

It is generally known to attach a drainage cover to a drainage channel. For example, it is known to use structures in the drainage channel for attaching the drainage cover.

SUMMARY

In a first aspect, a drainage channel is provided. The drainage channel includes a first sidewall provided with a first rail member extending along a longitudinal axis of the drainage channel. The first rail member includes a first rail opening. The drainage channel further includes a second sidewall extending along the longitudinal axis of the drainage channel. The first and second sidewalls at least partially define an interior area of the drainage channel. A first locking insert is at least partially positioned within the first rail opening of the first rail member. The first locking insert includes a first insert opening.

In one example of the first aspect, the first locking insert is interlocked with the first rail opening of the first rail member.

In another example of the first aspect, the first rail member defines a first seat. The drainage channel further comprises a cover extending across an upper opening of the interior area of the drainage channel and the cover is at least partially supported by the first seat of the first rail member in a seated position. In one example, a locking bar is interlocked with the first insert opening of the first locking insert, wherein the cover is attached to the locking bar such that the cover is removably locked relative to the first rail member in the seated position.

In another example of the first aspect, the first insert opening is at least partially defined by opposing lateral walls extending along the longitudinal axis. In one example, the first locking insert includes a rotational stop extending between the opposing lateral walls.

In a further example of the first aspect, the first rail member and the first locking insert are integrally embedded within the first sidewall.

The first aspect may be provided alone or in combination with one or any combination of examples of the first aspect discussed above.

In a second aspect, a drainage channel is provided. The drainage channel includes a first sidewall provided with a first rail member extending along a longitudinal axis of the drainage channel. The drainage channel further includes a second sidewall provided with a second rail member extending along the longitudinal axis of the drainage channel. The first and second sidewalls at least partially define an interior area of the drainage channel. A first locking insert is attached to the first rail member and defines a first insert opening. A second locking insert is attached to the second rail member and defines a second insert opening. A locking bar is attached to the first and second insert openings of the first and second locking inserts. A cover extends across an upper opening of the interior area of the drainage channel and is attached to the locking bar.

In one example of the second aspect, the first locking insert is interlocked with the first rail member and the second locking insert is interlocked the second rail member.

In yet another example of the second aspect, the first rail member defines a first seat and the second rail member defines a second seat, and the cover is supported by the first and second seats in a seated position. In one example, the cover is attached to the locking bar such that the cover is removably locked relative to the rail members in the seated position.

In yet another example of the second aspect, the insert openings of the locking inserts are each defined by opposing lateral walls extending along the longitudinal axis. In one example, each of the locking inserts includes a rotational stop extending between the respective opposing lateral walls.

In another example of the second aspect, the first rail member and the first locking insert are integrally embedded within the first sidewall, and the second rail member and the second locking insert are integrally embedded within the second sidewall.

The second aspect may be provided alone or in combination with one or any combination of examples of the second aspect discussed above.

In a third aspect, a method of making a drainage channel is provided. The method includes the step (I) of providing a first rail member with a first rail opening. The method further includes the step (II) of attaching a first locking insert to the first rail opening of the first rail member. The method further includes the step (III) of pouring a material into a channel mold to provide a channel form with a first form sidewall and a second form sidewall with the first rail member and the first locking insert being embedded within the first form sidewall of the channel form. The method then includes the step (IV) of solidifying the channel form into a solid channel body including the first solid sidewall and a second solid sidewall such that the first rail member and the first locking insert are integrally embedded within the first solid sidewall.

In an example of the third aspect, step (III) comprises a concrete mixture.

In yet another example of the third aspect, step (II) comprises interlocking the first locking insert with the first rail opening of the first rail member.

In another example of the third aspect, the method includes a step (V) of rotating a locking bar between an unlocked position in which an end of the locking bar is not inserted in the first insert opening of the first locking insert, and a locked position in which the end of the locking bar is positioned within the first insert opening of the first locking insert. In one example, the method further includes a step (VI) of positioning a cover to extend across an opening of an interior area of the solid channel body and to be supported at least partially by a first seat of the first rail member in a seated position. In still another example, the method further includes a step (VII) of attaching the cover to the locking bar such that the cover is locked to the first rail member in the seated position.

The third aspect may be provided alone or in combination with one or any combination of examples of the third aspect discussed above.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

Figure 1:
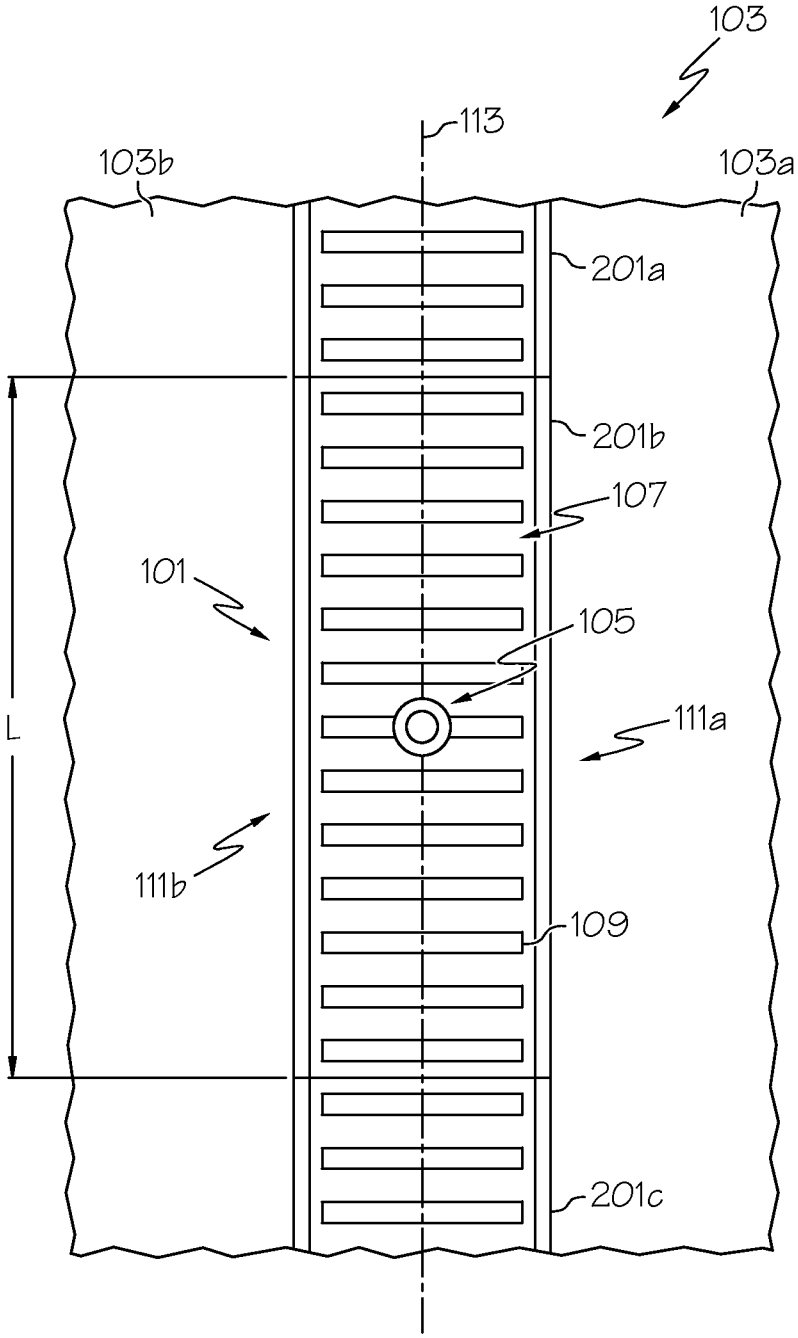
FIG. 1 is a top plan view of an example drainage channel in accordance with aspects of the disclosure.

The present invention will now be described more fully hereinafter with reference to the accompanying drawings in which example embodiments of the invention are shown. Whenever possible, the same reference numerals are used throughout the drawings to refer to the same or like parts. However, this invention may be embodied in many different forms and should not be construed as limited to the embodiments set forth herein. These example embodiments are provided so that this disclosure will be both thorough and complete, and will fully convey the scope of the invention to those skilled in the art.

Referring to FIG. 1, an example drainage channel 101 is shown. The drainage channel 101 can be positioned adjacent a surface 103, such as a natural grass surface, turf surface, synthetic surface, stone, bricks, gravel, concrete, asphalt or the like. The drainage channel 101 may be positioned receive runoff, such as water, liquid, debris, etc., whereupon the runoff can be drained through the drainage channel 101. Further, while the surface 103 is shown as two surfaces 103*a*, 103*b* extending along opposing sides 111*a*, 111*b* of the drainage channel 101, in further examples, the surface 103 may only be positioned along a single side of the drainage channel 101.

As will be described in detail below, the drainage channel 101 can include a locking structure 105 that can attach a cover 107 to a locking bar of the drainage channel 101. The cover 107 is designed to extend across an upper opening to an interior area of the drainage channel 101. The cover can have a plurality of openings, such as the illustrated slots 109, configured to allow runoff to pass through the cover 107 and into the interior area of the drainage channel 101. The cover 107 can be designed to have sufficient structural integrity for the desired application. For example, the cover 107 can be designed to withstand the forces of vehicles traveling over the cover 107. A light weight cover 107 may also be designed in other applications where heavy loads are not contemplated.

Figure 2:
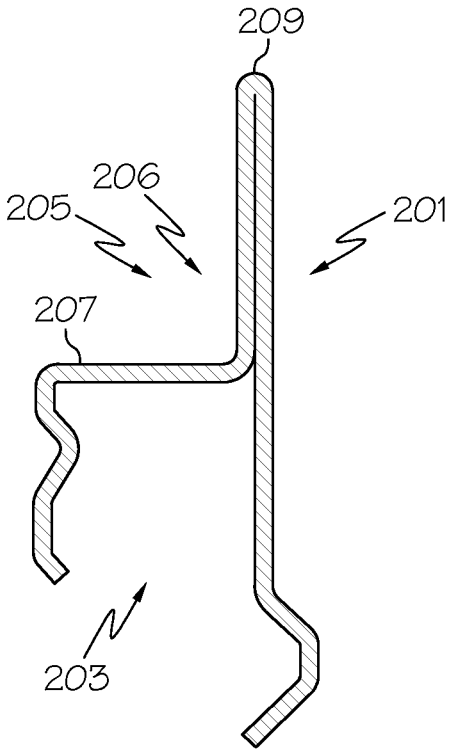
FIG. 2 is a sectional view of the example rail member of the drainage channel of FIG. 1.

FIG. 2 is a sectional view of an example rail member 201 of the drainage channel 101. Although not required in all examples, the cross sectional profile of the rail member 201 can be configured to extend along a longitudinal axis 113 of the drainage channel 101. In one example, the cross sectional profile of the rail member 201 can remain substantially constant along substantially the entire length "L" of the drainage channel 101. The rail member 201 may be formed from plastic, resin, metal and/or other materials depending on the application. In one example, the rail member 201 can comprise plastic that is extruded from a die having an extrusion profile matching a cross-sectional profile of the rail member 201. In the illustrated example, the rail member 201 can comprise metal, such as stainless steel, that may be bent into the configuration shown in FIG. 2. Providing the rail member 201 from stainless steel or other metal may provide enhanced durability and resistance to corrosion that may extend the life of the rail member 201 in various applications.

As further shown in FIG. 2, the rail member 201 includes a rail opening 203 that may receive at least a portion of a locking insert 301 (see FIG. 3) as discussed more fully below. The rail member 201 can also include a seat 205 configured to support a corresponding side of the cover 107. As shown, in one example the seat can comprise an L-shaped member 206 including a first portion 207 configured to extend horizontally to support weight and/or other forces associated with the cover 107. The L-shaped member can further include a second portion 209 configured to provide a lateral stop for the cover 107 to help appropriately align the cover member along the longitudinal axis 113 of the drainage channel 101.

Figure 3:
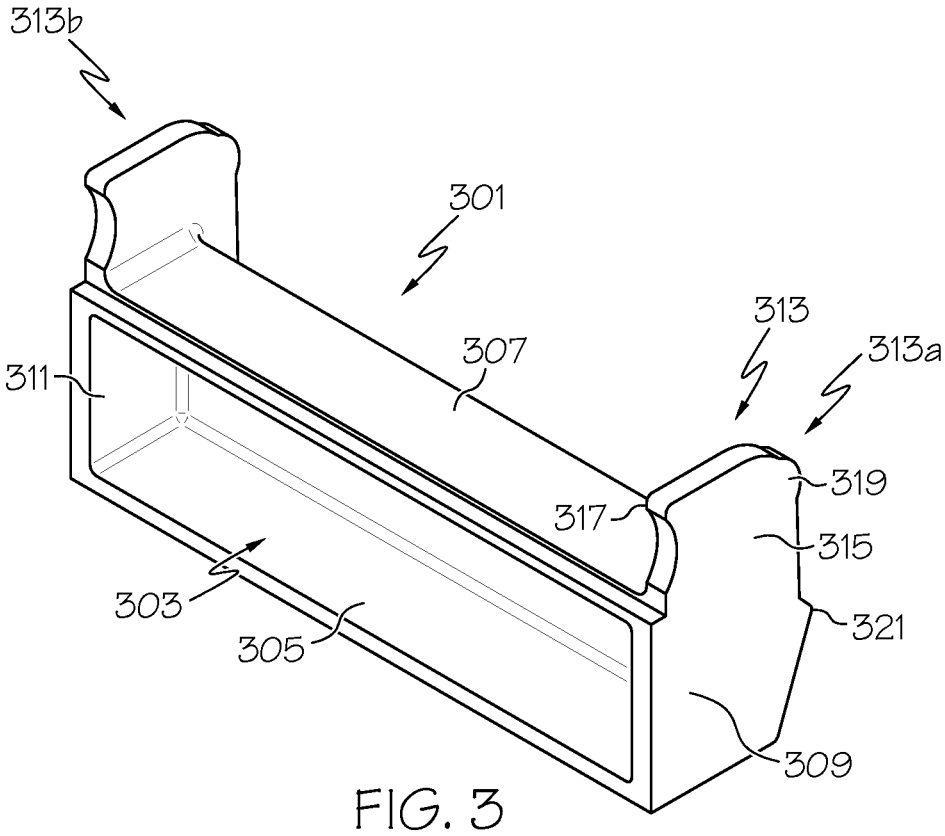
FIG. 3 is a perspective view of an example locking insert of the drainage channel of FIG. 1.

FIG. 3 illustrates a perspective view of one example locking insert 301 of the drainage channel 101. The locking insert is configured to be at least partially positioned within the rail opening 203 of the rail member 201. As such, the locking insert 301 can be attached to the rail member 201 at any desired location along the length "L" of the drainage channel 101. As such, manufacturing of the drainage channel 101 may be simplified since relatively complicated and expensive manufacturing techniques to predetermine and locate insert openings for the locking bar (discussed below) may be avoided. Moreover, customization of various drainage channel 101 lengths and configurations may be simplified by use of the locking insert 301 that may be located at any desired location along the rail member 201. For example, as shown in FIG. 1, rail members 201*a*, 201*b*, 201*c*, may be aligned in series and joined end-to-end to increase the overall effective length of the drainage channel. The rail members 201*a*, 201*b*, 201*c* may comprise the same length or different lengths. Due to the versatility of the locking insert 301, a single rail member 201 may be cut to the desired length and then the locking insert 301 may be attached to the desired location along the length to allow customization of the drainage channel. Less inventory space is required for stocking the rail members since different length rail members 201 with different configurations need not be stored separately. Rather, a single sized rail member may be produced and stored. If necessary, these rail members may be later cut to the desired length depending on the particular application Turning back to FIG. 3, the locking insert 301 can include an insert opening 303 configured to receive a corresponding end of a locking bar discussed below. In one example, the insert opening 303 of the locking insert 301 is at least partially defined by opposing lateral walls 305, 307 configured to extend along the longitudinal axis 113 of the drainage channel 101. The locking insert 301 can also include a rotational stop extending between the opposing lateral walls. For example, as shown in FIG. 3, the locking insert 301 include two rotational stops 309, 311 although a single rotational stop may be provided in further examples. The rotational stops facilitate proper alignment of the locking bar as discussed more fully below. While providing a single rotational stop is possible, providing the illustrated two rotational stops can allow a single rotational stop design to be used for the first and second sidewalls. As such, the single rotational stop design can reduce inventory requirements and simplify assembly procedures.

Still further, the locking insert can include an attachment mechanism 313. As shown in FIG. 3, the attachment mechanism can comprise a first attachment mechanism 313*a* and a second attachment mechanism 313*b* located at opposite sides of the locking insert although a single or more than two attachment mechanisms may be provided in further examples. In addition, the attachment mechanisms maybe identical to one another (as shown in FIG. 3) or different from one another in further examples. The attachment mechanism 313 may comprise various configurations. For instance, the attachment mechanism may comprise a fastener, such as a screw or other connection between the rail member 201 and the locking insert 301. In further examples, the attachment mechanism may simply comprise an interference fit between the rail member 201 and the locking insert 301. In still further examples, the rail member 201 and locking insert 301 may be glued, welded or otherwise attached to one another.

In the illustrated example, the locking insert 301 can include features that allow interlocking of the locking insert 301 to the rail member 201 at the desired location. Such interlocking may comprise toolless interlocking in some examples wherein manual installation may be easily achieved by carrying out an interlocking engagement between the locking insert 301 and the rail member 201. Various interlocking members and configurations may be provided in accordance with aspects of the disclosure. For example, as shown in FIG. 3, each attachment mechanism 313*a*, 313*b* can comprise the example illustrated interlocking member 315. The interlocking member 315 of the first attachment mechanism 313*a* will be described with the understanding that the interlocking member of the second attachment mechanism 313*b* can be identical (as shown) or similar in further examples. As shown, the interlocking member 315 can include a first protrusion 317, a second protrusion 319 and a third protrusion 321 although more or less protrusions may be provided with the illustrated or different configurations in further examples. The locking insert may comprise various materials such as metal (e.g., steel), resin, plastic and/or other materials. In one example, the locking insert comprises plastic that may be injection molded or otherwise fabricated to achieve the configuration illustrated in FIG. 3. Providing the locking insert as plastic can provide inexpensive manufacture of the locking insert (e.g., by injection molding) while allowing efficient and inexpensive attachment of the locking insert to the rail member in the desired location.

Figure 4:
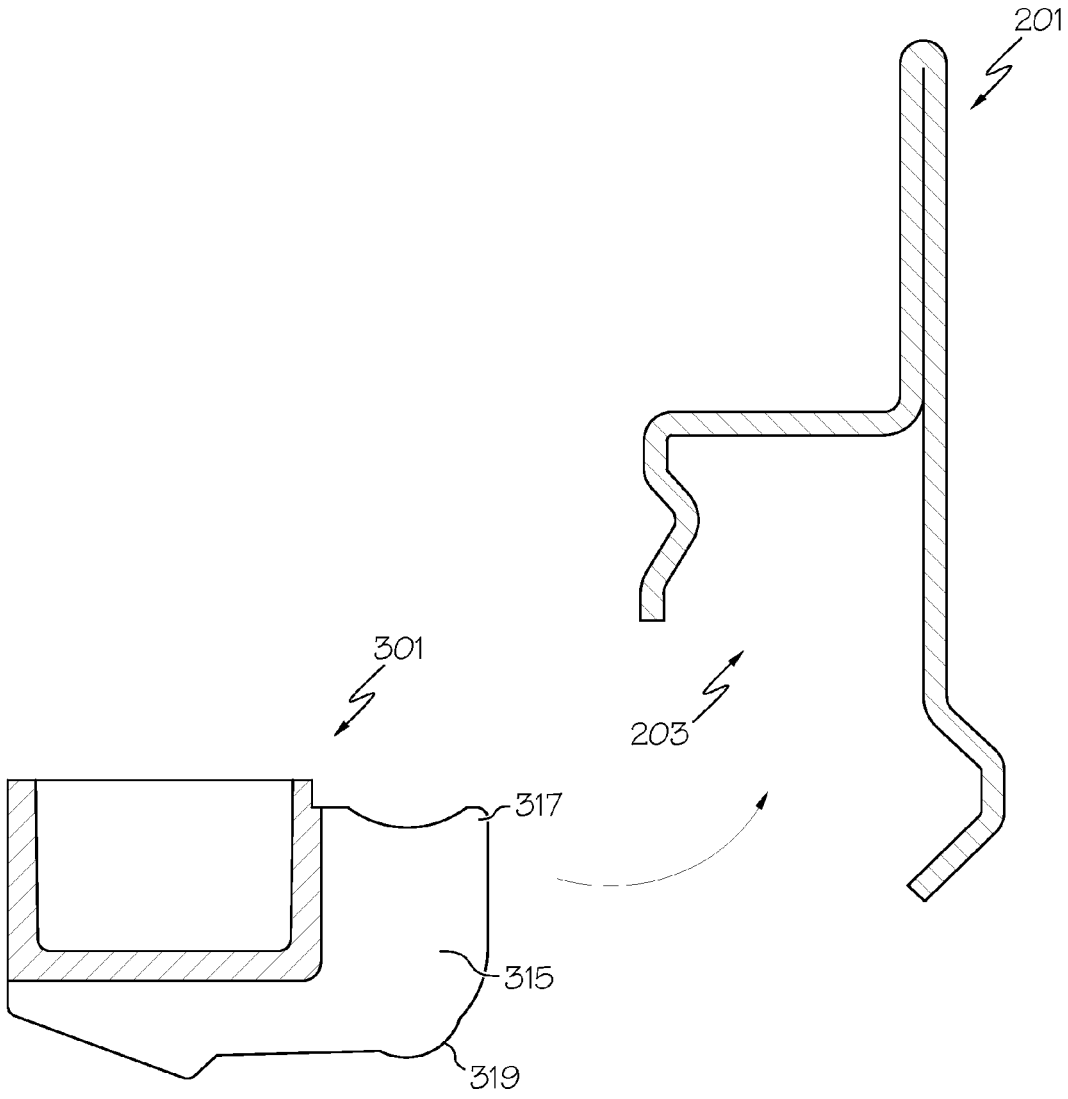
FIG. 4 illustrates an example step of attaching the locking insert of FIG. 3 to the rail member of FIG. 2.
Figure 5:
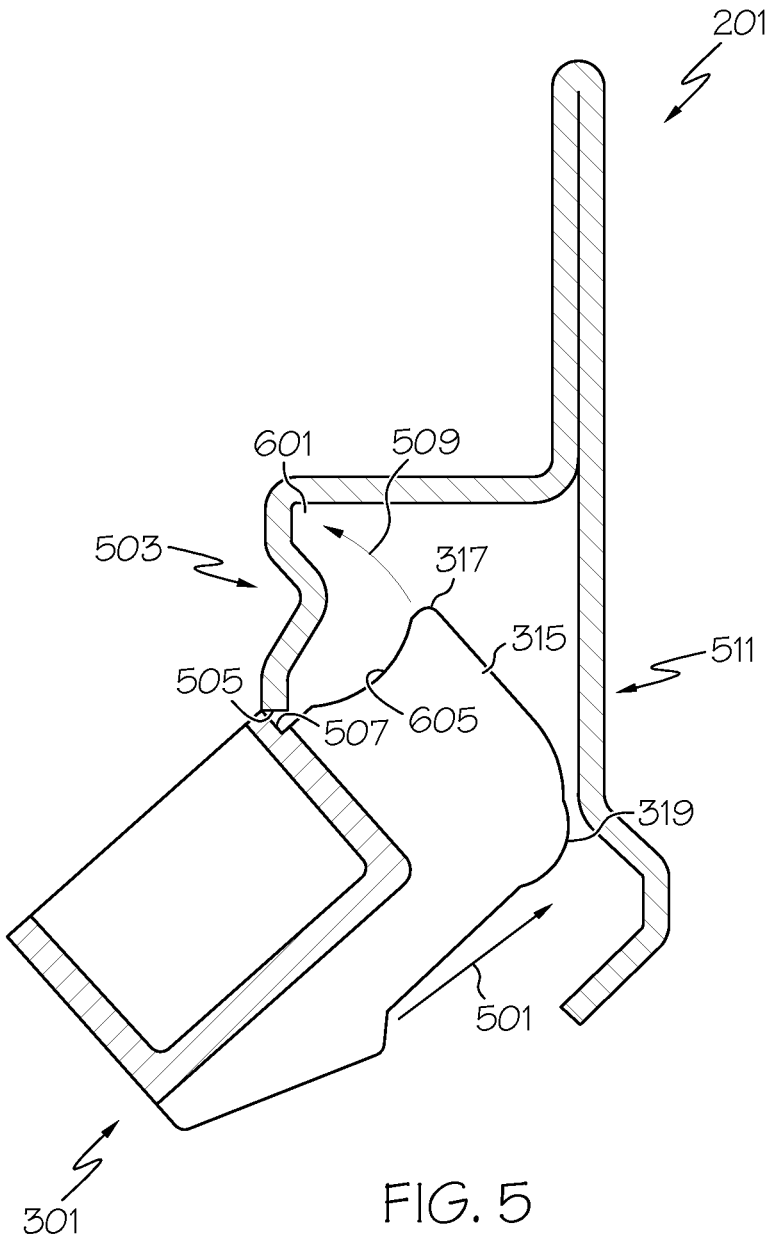
FIG. 5 illustrates an example step of interlocking the locking insert with a rail opening of the rail member.
Figure 6:
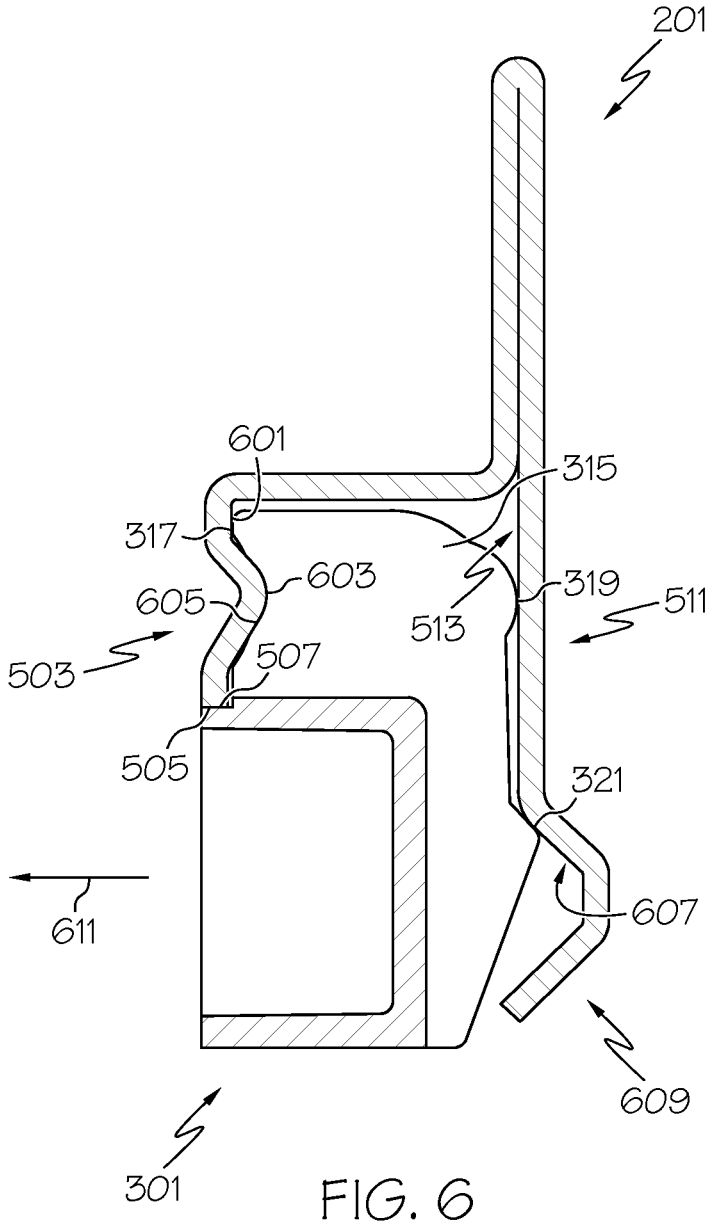
FIG. 6 illustrates the locking insert being interlocked the rail member.

FIGS. 4-6 illustrate example steps of attaching the locking insert 301 to the rail member 201 by way of an interlocking attachment. As shown in FIG. 4, the first protrusion 317 and second protrusion 319 of the interlocking member 315 can be inserted within the rail opening 203. As shown in FIG. 5, the locking insert 301 can be moved in direction 501 until a lower edge 505 of a first locking flange 503 of the rail member 201 is engaged with a seat 507 of the locking insert 301. The locking insert 301 can then be pivoted in direction 509 wherein the second protrusion 319 is snapped behind a second locking flange 511 of the rail member 201 and seated against an interior surface 513 of the second locking flange 511 as shown in FIG. 6. At the same time, the first protrusion 317 is seated within a notch 601 defined between an inner lip 603 of the first locking flange 503 and the first portion 207 of the L-shaped member 206. As shown in FIG. 6, once seated the inner lip 603 of the first locking flange 503 is also received within a recess 605 defined in the interlocking member 315 of the locking insert 301.

As also shown in FIG. 6, once the locking insert 301 is interlocked with the rail member 201, the third protrusion 321 is seated against a downwardly facing surface 607 of an anchor portion 609 of the second locking flange 511. As such, FIG. 6 shows the locking insert 301 being interlocked with respect to the rail member 201 in the desired location along the length of the rail member 201. The engagement of the third protrusion 321 against the downwardly facing surface 607 acts as a rotational stop to prevent further pivoting of the locking insert 301 relative to the rail member 201 and therefore appropriately positions the insert opening 303 of the locking insert 301 in the appropriate direction 611. Once seated against the interior surface 513 of the second locking flange 511, the second protrusion 319 acts as a stop to prevent undesired pivoting in a direction opposite to direction 509 that may otherwise result in unintentional disengagement of the locking insert 301 form the rail member 201. Still further, seating of the first protrusion 317 within the notch 601 and the inner lip 603 within the recess 605 prevents the locking insert 301 from downwardly traversing relative to the rail member 201 out of the interlocked engagement shown in FIG. 6.

Figure 7:
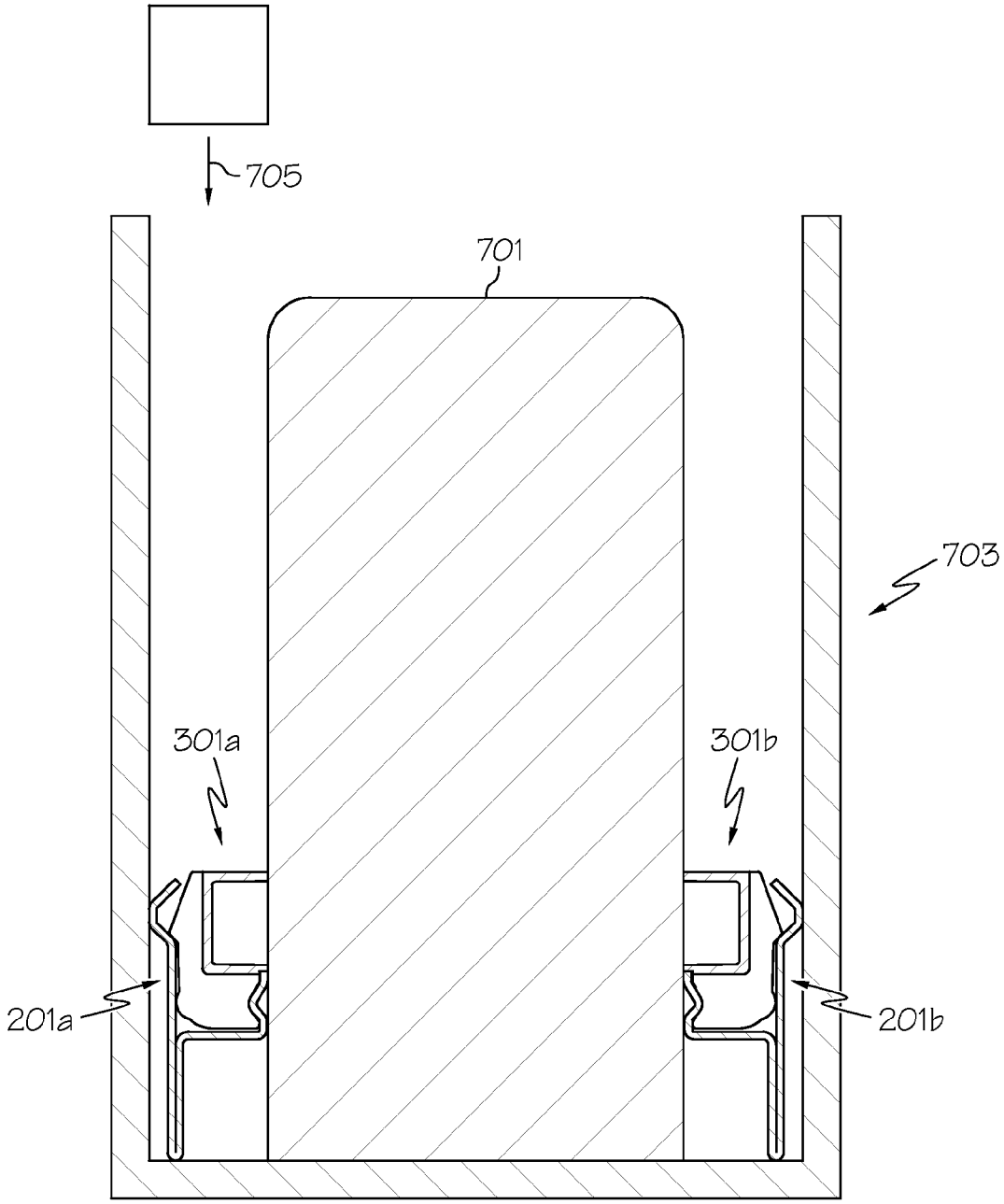
FIG. 7 illustrates two rail members of FIG. 6 being placed within a channel mold and a method step of pouring a material into the channel mold.

An example method of making a drainage channel will now be described with reference to FIG. 7. Initially, a first locking insert may be provided and a first rail member may be provided with a first rail opening. In one example, the method can include fabricating the first locking insert and the first rail member although the step of providing the first locking insert and the first rail member may include obtaining a prefabricated first locking insert and first rail member. In one example, as shown in FIG. 7, a first rail member 201*a* may be provided that may be identical to the rail member 201 illustrated in FIG. 2. A first locking insert 301*a* may also be provided that is identical to the locking insert 301 illustrated in FIG. 3.

The method can further include the step of attaching the first locking insert 301*a* to the first rail opening of the first rail member 201*a*. Optionally, the method can likewise include the steps of providing a second locking insert 301*b* and second rail member 201*b* with the step of attaching the second locking insert 301*b* to a second rail opening of the second rail member 201*b*. In one example, the step of attaching can comprise interlocking the first/second locking insert 301*a*, 301*b* with the corresponding first/second rail opening of the respective first/second rail member 201*a*, 201*b* although other attachment techniques may be provided in further examples.

As shown in FIG. 7, the rail members 201*a*, 201*b* with interlocked locking inserts 301*a*, 301*b* may then be placed about a mold core 701 within a channel mold 703. Next, the method may include the step of pouring a material 705 into the channel mold 703. Various materials can be used in accordance with aspects of the disclosure. For instance, a cement mixture may be poured into the channel mold to subsequently solidify into a solid channel. In one example, the cement mixture comprises a concrete mixture that is configured to be cured into a polymer concrete.

Figure 8:
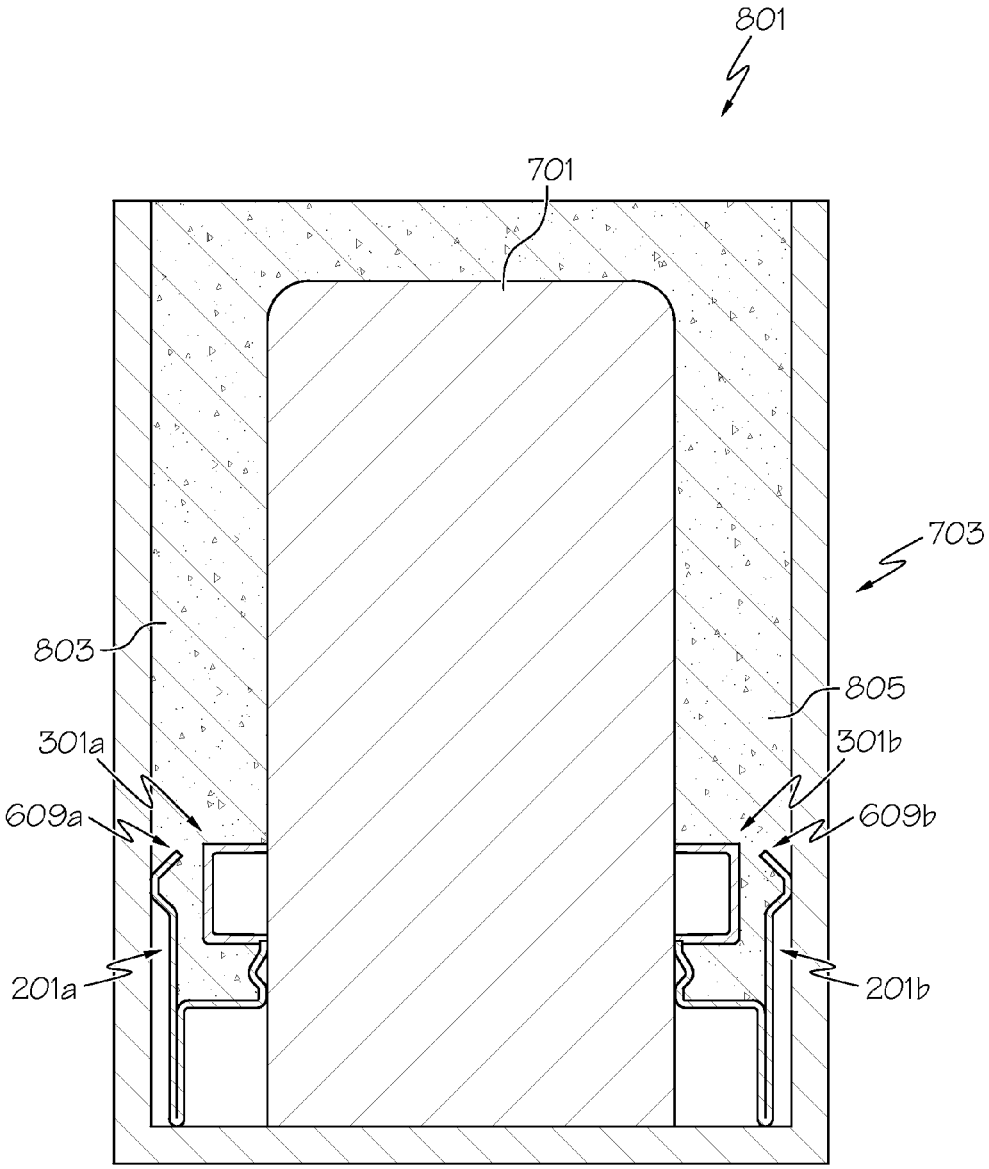
FIG. 8 illustrates a channel form with a first form sidewall and a second form sidewall with a first rail member and a first locking insert being embedded within the first form sidewall and a second rail member and a second locking insert being embedded within the second form sidewall.

FIG. 8 demonstrates that pouring the mixture into the channel mold can provide a channel form 801 with a first form sidewall 803 and a second form sidewall 805 with the first rail member 201*a* and the first locking insert 301*a* being embedded within the first form sidewall 803 of the channel form 801. If provided, the second rail member 201*b* and the second locking insert 301*b* can be embedded within the second form sidewall 305 of the channel form 801. The cement mixture can flow into the rail opening 203 and may fill the interior area of the rail member in and about the first and second locking inserts 301*a*, 301*b* as shown in FIG. 8. Gravity may assist the cement mixture to flow within the interior area of the rail member although agitation of the cement mixture and/or shaking or vibration of the channel mold 703 may also assist movement of the cement mixture into the rail opening 203 and into the interior area of the rail member in and about the first and second locking inserts 301*a*, 301*b*.

Figure 9:
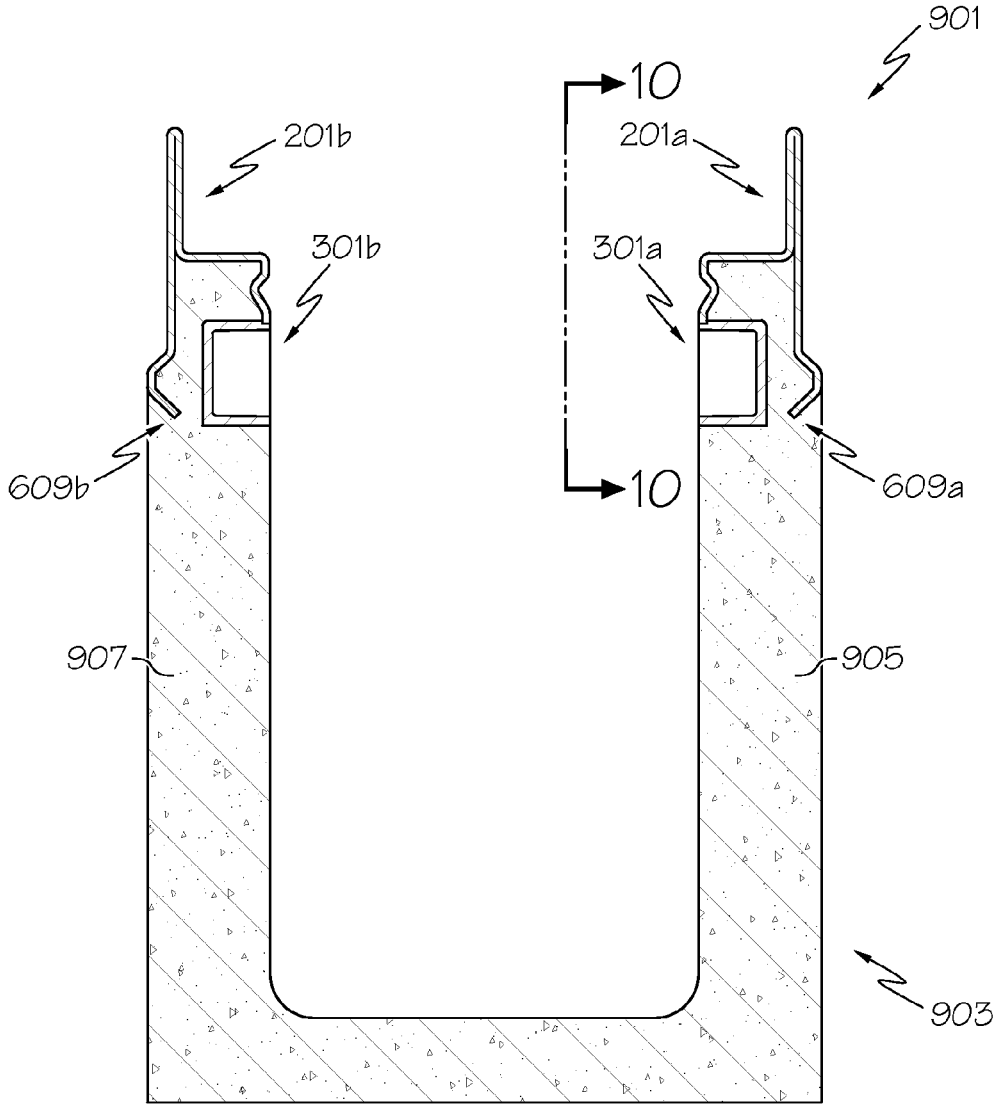
FIG. 9 illustrates the channel form of FIG. 8 after being removed from the channel mold to provide the drainage channel.

The method can then solidify the channel form 801 into a drainage channel member with a solid channel body. For example, the process of solidifying can be carried out within the channel mold 703. Once solidified, the channel mold 703 and the mold core 701 may be removed. As shown in FIG. 9, a drainage channel member 901 is then provided with a solid channel body 903 including a first solid sidewall 905 and a second solid sidewall 907. The first rail member 201*a* and the first locking insert 301*a* are integrally embedded within the first solid sidewall 905. Indeed, the cement mixture within the interior and about the first rail member 201*a* and the first locking insert 301*a* is solidified such that the first rail member 201*a* and the first locking insert 301*a* are integrally embedded within the first solid sidewall 905. The first anchor portion 609*a* can help anchor the first rail member 201*a* within the first solid sidewall 905.

The second rail member 201*b* and the second locking insert 301*b*, if provided, can also be integrally embedded within the second solid sidewall 907. Indeed, the cement mixture within the interior and about the second rail member 201*b* and the second locking insert 301*b* is solidified such that the second rail member 201*b* and the second locking insert 301*b* are integrally embedded within the second solid sidewall 907. The second anchor portion 609*b* can help anchor the second rail member 201*b* within the second solid sidewall 907.

Figure 10:
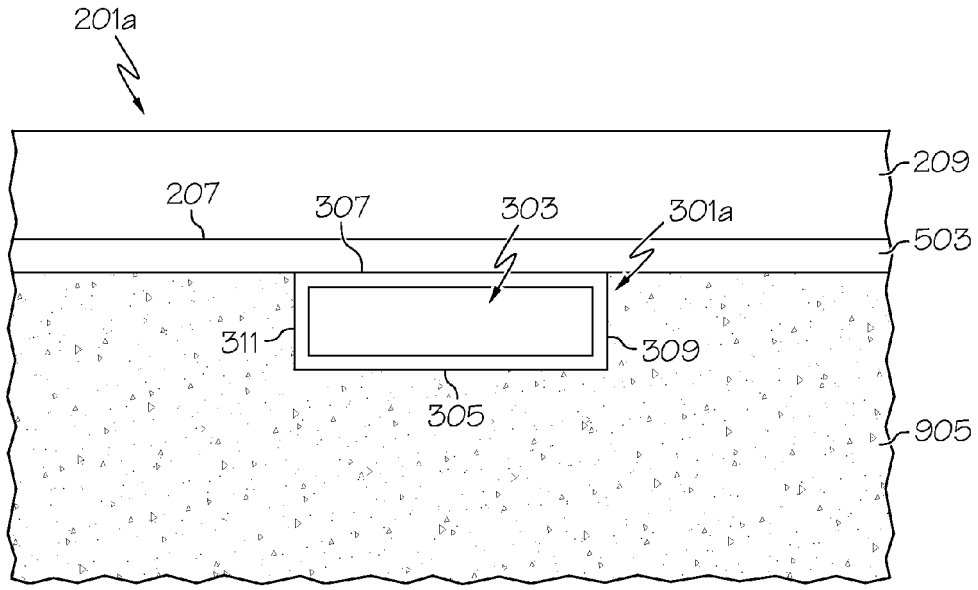
FIG. 10 illustrates a side view of a portion of a first sidewall of the drainage channel along line 10-10 of FIG. 9.

FIG. 10 shows an interior view of portions of the first solid sidewall 905 with the first locking insert 301*a* integrally embedded therein with the understanding that the second solid sidewall 907 with the second locking insert 301*b* integrally embedded therein would appear similar, such as identical to FIG. 10. As shown in FIG. 10, the first locking insert 301*a* is integrally embedded within the first solid sidewall 905 such that the insert opening 303 of the first locking insert 301*a* is exposed for easy access by a corresponding end of a locking bar as discussed more fully below.

Figure 11:
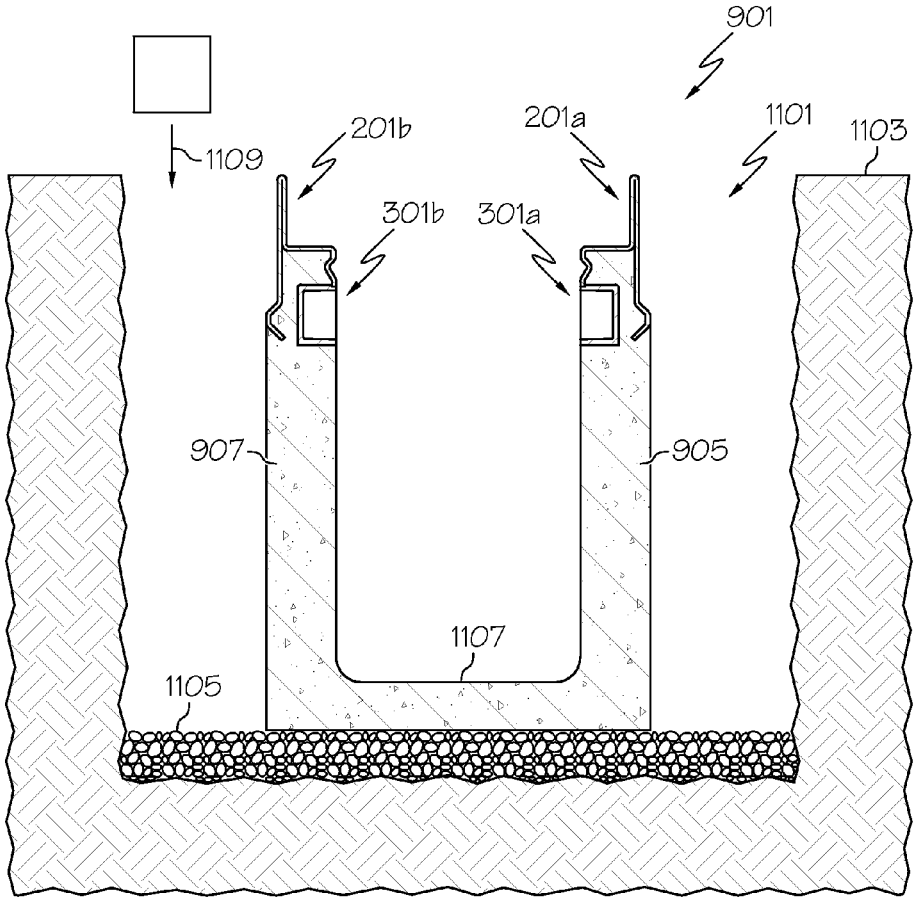
FIG. 11 illustrates an example method step of placing the drainage channel in a trench and pouring an anchoring material within the trench.
Figure 12:
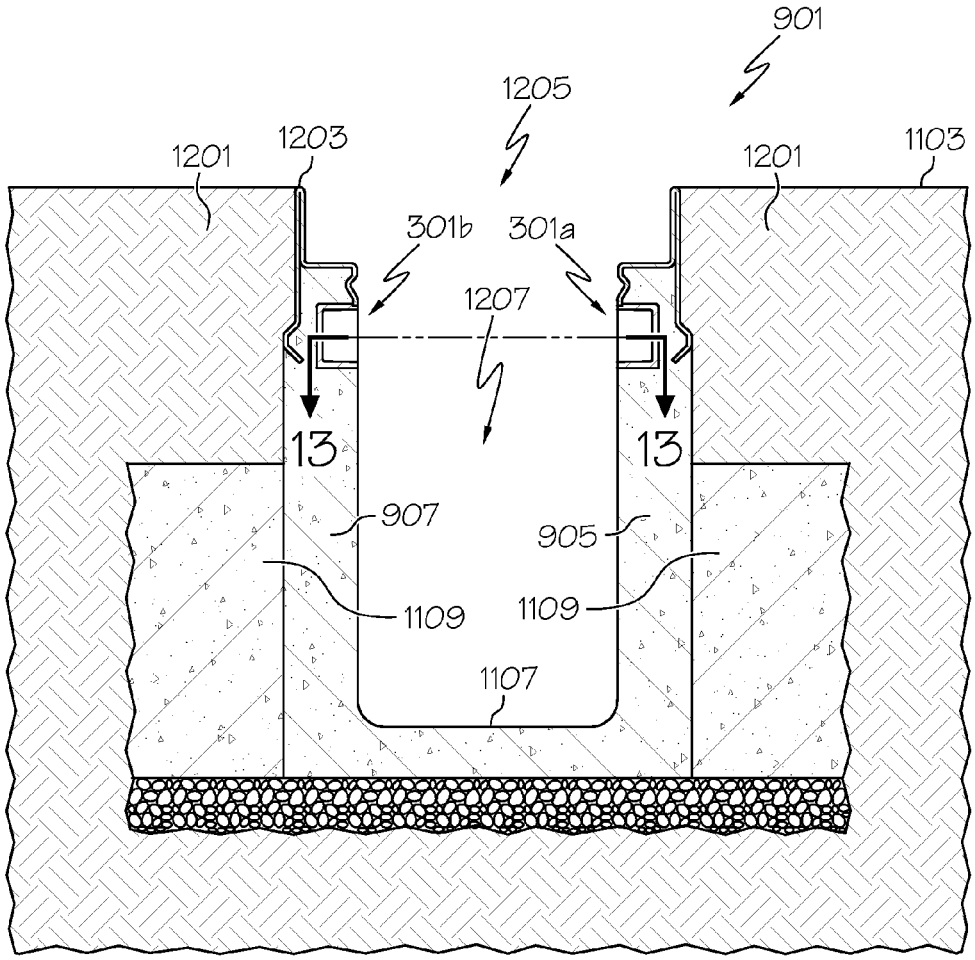
FIG. 12 illustrates an example of the drainage channel being anchored within the trench of FIG. 11.

FIGS. 11 and 12 illustrate an example technique for installing the drainage channel member 901 although the drainage channel member may be installed in various other ways. For instance, as shown in FIG. 11, a trench 1101 may be dug in the ground 1103. Gravel or sand 1105 may be placed at the bottom of the trench 1101 and tamped to provide a desired footer that may be level or inclined depending on the particular application. Although not shown, concrete may be added and tamped over the gravel or sand 1105 to firmly seat a base 1107 of the drainage channel member 901. Additional drainage channel members may be provided in series (e.g., end-to-end) to achieve the desired overall length of the drainage channel. Concrete material 1109 may then be added within the trench 1101 to seat the drainage channel members(s) 901 in place. As shown in FIG. 12, backfill 1201 may then be added to the level of the upper end 1203 of the drainage channel member 901. Once installed, an upper opening 1205 of an interior area 1207 of the drainage channel member 901 is configured to receive runoff from the adjacent surface of the ground 1103.

Figure 13:
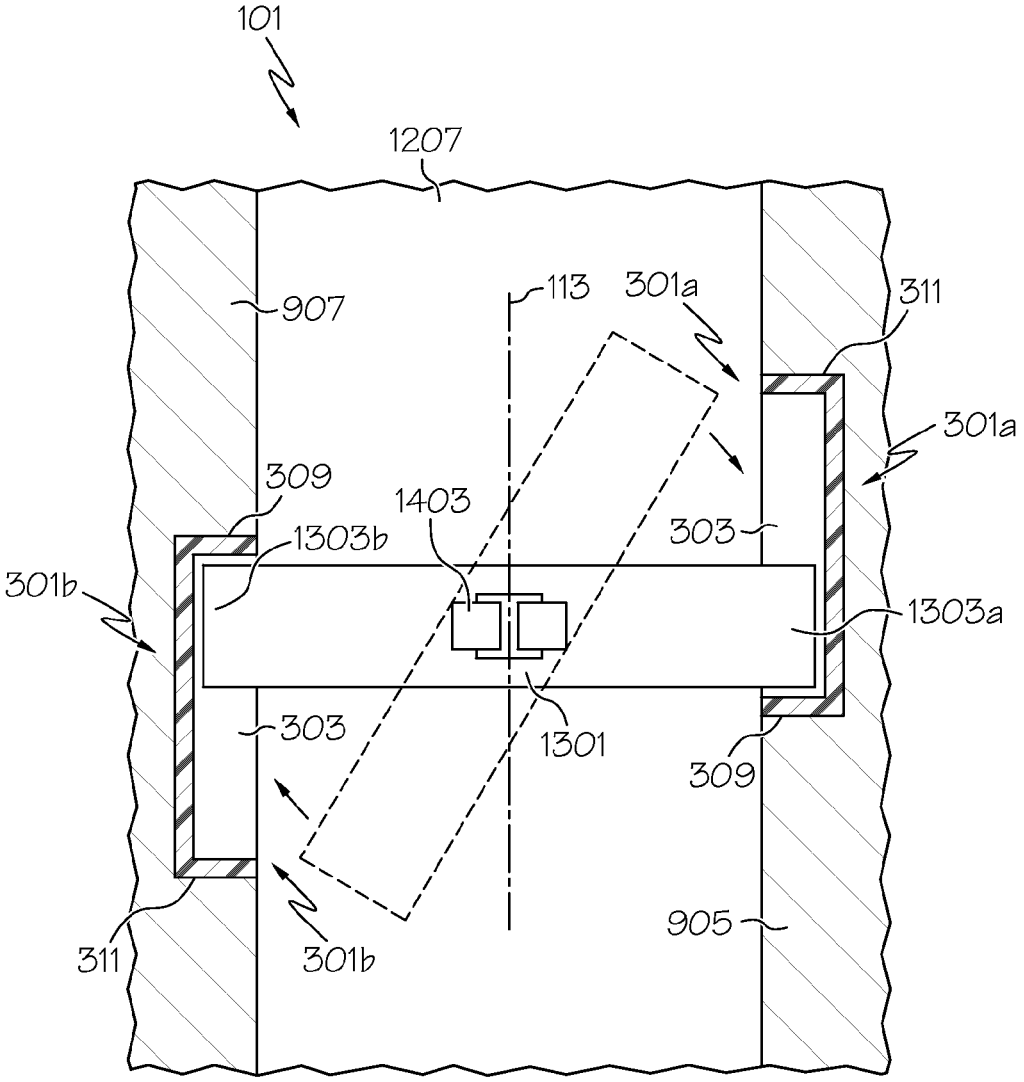
FIG. 13 is a sectional view of the drainage channel along line 13-13 of FIG. 12 demonstrating an example method step of interlocking a locking bar with the first and second rail members.
Figure 14:
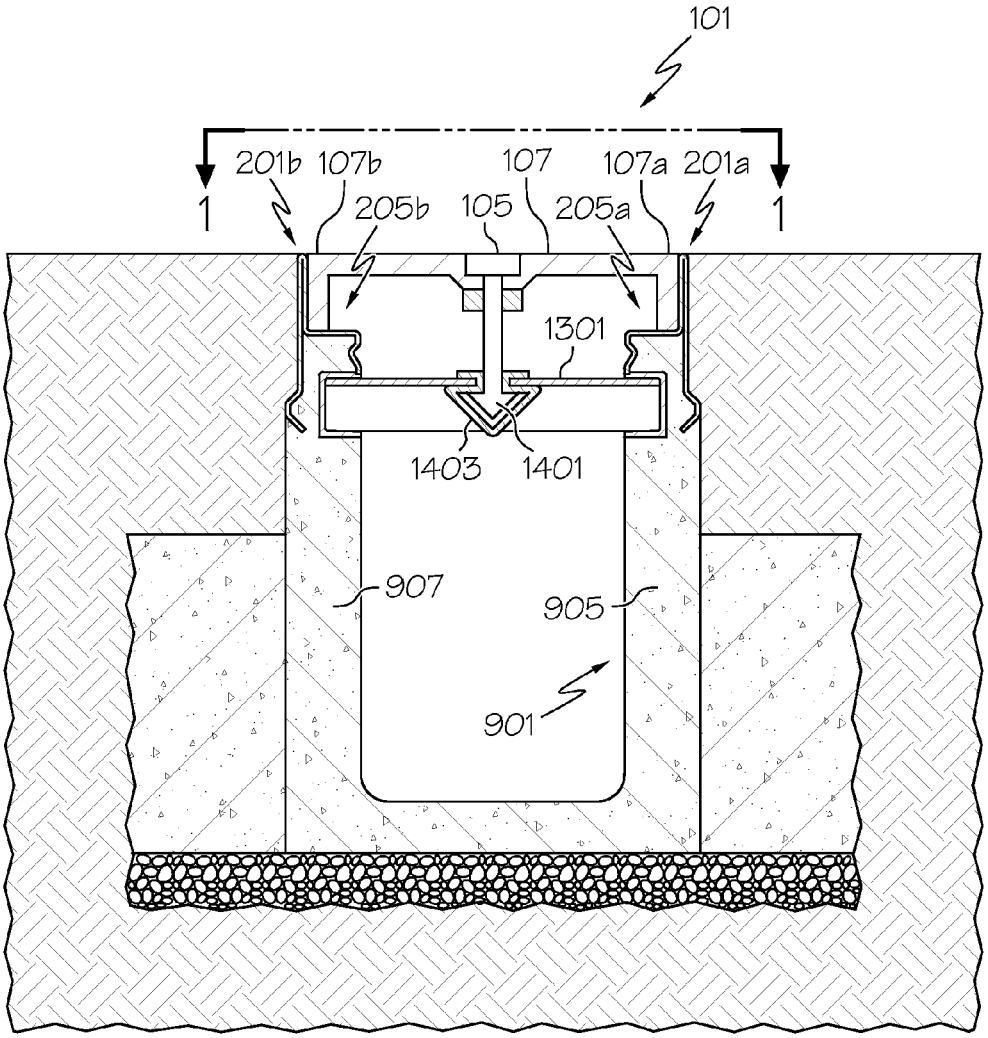
FIG. 14 illustrates an example cover being mounted to the locking bar of FIG. 13.

FIGS. 13 and 14 illustrate method steps of installing the cover across the upper opening 1205 of the interior area 1207 of the drainage channel member 901. Initially, a locking bar 1301 may be inserted into the interior area 1207 of the drainage channel member 901 adjacent the first locking insert 301*a* and the second locking insert 301*b* at the elevation of the interior areas 303 of the locking inserts 301*a*, 301*b*. The locking bar can then be rotated (e.g., clockwise as shown in FIG. 13) such that the end portions 1303*a*, 1303*b* of the locking bar 1301 are seated within the respective interior areas 303 of the locking inserts 301*a*, 301*b* and engaged with the respective rotational stops 309. As such, example methods can include the step of rotating the locking bar 1301 between an unlocked position (see broken lines in FIG. 13) and a locked position (shown in solid lines in FIG. 13). As shown by the broken lines of FIG. 13, in the unlocked position, the first end portion 1303*a* of the locking bar 1301 is not inserted in the first insert opening 303 of the first locking insert 301*a* and in which the second end portion 1303*b* of the locking bar 1301 is not inserted in the first insert opening 303 of the second locking insert 301*b*. In the locked position, the first end portion 1303*a* of the locking bar is inserted in the first insert opening 303 of the first locking insert 301*a* and in which the second end portion 1303*b* of the locking bar 1301 is inserted in the second insert opening 303 of the second locking insert 301*b*. As shown by the solid lines in FIG. 13, in the locked position, the locking bar 1301 is interlocked with the first and second rail members 201*a*, 201*b*.

Next, as shown in FIG. 14, the method can further include the step of positioning the cover 107 to extend across the opening 1205 of the interior area 1207 of the solid channel body 903 and to be supported at least partially by the first seat 205 of the first rail member 201*a* and the second seat 205 of the second rail member 201*b* in a seated position. The method can further include the step of attaching the cover 107 to the locking bar 1301 such that the cover 107 is locked relative to the first rail member 201*a* and the second rail member 201*b* in the seated position. For example, as shown, the locking structure 105 of the cover 107 can include a snap portion 1401 configured to engage a snap portion 1403 associated with the locking bar 1301 to lock the cover 107 relative to the first and second rail members 201*a*, 201*b*.

FIG. 14 therefore illustrates the drainage channel 101 comprising the drainage channel member 901 comprising a first sidewall 905 and a second sidewall 907 that each extend along the longitudinal axis 113 and at least partially define the interior area 1207 of the drainage channel 101. The first sidewall 905 can be provided with the first rail member 201*a* including the first rail opening and the second sidewall 907 can be provided with the second rail member 201*b* including the second rail opening. The first locking insert 301*a* can be at least partially positioned within the first rail opening of the first rail member 201*a*. Likewise, the second locking insert 301*b* can be at least partially positioned within the second rail opening of the second rail member 201*b*. In one example, the first locking insert 301*a* is interlocked with the first rail opening of the first rail member 201*a* and the second locking insert 301*b* is interlocked with the second rail opening of the second rail member 202*b*.

The first rail member 201*a* defines a first seat 205*a* and the second rail member 201*b* defines a second seat 205*b*. The drainage channel can further include the cover 107 extending across the upper opening 1205 of the interior area 1207 of the drainage channel 101. The cover 107 is at least partially supported by the first and second seats of the first and second rail members in a seated position. For example, as shown in FIG. 14, the cover 107 includes a first side 107*a* at least partially supported by the first seat 205*a* and a second side 107*b* at least partially supported by the second seat 205*b* in the seated position. Referring to FIG. 2, the first portion 207 of the L-shaped member 206 of each of the first and second rail members 201*a*, 201*b* supports the weight and forces applied by the first and second sides 107*a*, 107*b* of the cover 107. As further illustrated in FIG. 2, the second portion 209 of the L-shaped member 206 of each of the first and second rail members 201*a*, 201*b* helps laterally align the cover member with respect to the longitudinal axis 113 of the drainage channel 101.

FIG. 14 further illustrates the locking bar 1301 being optionally interlocked with the first insert opening of the first locking insert 301*a* and the second insert opening of the second locking insert 301*b*. The cover 107 is attached to the locking bar 1301 such that the cover 107 may be removably locked relative to the first and second rail members 201*a*, 201*b* in the seated position.

As further illustrated, the first rail member 201*a* and the first locking insert 301*a* are integrally embedded within the first sidewall 905 and the second rail member 201*a* and the second locking insert 301*b* are integrally embedded within the second sidewall 907. Providing the first and second locking inserts 301*a*, 301*b* as separate components allows customization of the drainage channels with reduced effort and reduced inventory requirements. At the same time, the rail member and locking inserts may be integrally formed with the first and second sidewalls 905, 907 to provide an integral drainage channel having sufficient structural rigidity to help mount the cover 107 in place relative to the remaining portions of the drainage channel. Various formation techniques may be provided to form drainage channels having different configurations. As shown, the interior area 1207 can have a generally U-shaped cross-section although a V-shaped cross-section or other cross-sectional shape may be provided in further examples.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A drainage channel comprising:

a first sidewall provided with a first rail member extending along a longitudinal axis of the drainage channel, the first rail member including a first rail opening;

a second sidewall extending along the longitudinal axis of the drainage channel, wherein the first and second sidewalls at least partially define an interior area of the drainage channel; and a first locking insert at least partially positioned within the first rail opening of the first rail member, the first locking insert including a first insert opening, wherein the first locking insert is a separate component that is embedded within the first sidewall.

2. The drainage channel of claim 1, wherein the first locking insert is interlocked with the first rail opening of the first rail member.

3. The drainage channel of claim 1, wherein the first rail member defines a first seat, and the drainage channel further comprises a cover extending across an upper opening of the interior area of the drainage channel and the cover being at least partially supported by the first seat of the first rail member in a seated position.

4. The drainage channel of claim 3, further including a locking bar interlocked with the first insert opening of the first locking insert, wherein the cover is attached to the locking bar such that the cover is removably locked relative to the first rail member in the seated position.

5. The drainage channel of claim 1, wherein the first insert opening is at least partially defined by opposing lateral walls extending along the longitudinal axis.

6. The drainage channel of claim 5, wherein the first locking insert includes a rotational stop extending between the opposing lateral walls.

7. The drainage channel of claim 1, wherein the first rail member and the first locking insert are integrally embedded within the first sidewall.

8. A drainage channel comprising:

a first sidewall provided with a first rail member extending along a longitudinal axis of the drainage channel;

a second sidewall provided with a second rail member extending along the longitudinal axis of the drainage channel, wherein the first and second sidewalls at least partially define an interior area of the drainage channel;

a first locking insert attached to the first rail member and defining a first insert opening, wherein the first locking insert is a separate component that is embedded within the first sidewall;

a second locking insert attached to the second rail member and defining a second insert opening, wherein the second locking insert is a separate component that is embedded within the second sidewall;

a locking bar attached to the first and second insert openings of the first and second locking inserts; and a cover extending across an upper opening of the interior area of the drainage channel and attached to the locking bar.

9. The drainage channel of claim 8, wherein the first locking insert is interlocked with the first rail member and the second locking insert is interlocked with the second rail member.

10. The drainage channel of claim 8, wherein the first rail member defines a first seat and the second rail member defines a second seat, and the cover is supported by the first and second seats in a seated position.

11. The drainage channel of claim 10, wherein the cover is attached to the locking bar such that the cover is removably locked relative to the rail members in the seated position.

12. The drainage channel of claim 8, wherein the insert openings of the locking inserts are each defined by opposing lateral walls extending along the longitudinal axis.

13. The drainage channel of claim 12, wherein each of the locking inserts includes a rotational stop extending between the respective opposing lateral walls.

14. The drainage channel of claim 8, wherein the first rail member and the first locking insert are integrally embedded within the first sidewall, and the second rail member and the second locking insert are integrally embedded within the second sidewall.

15. A method of making a drainage channel comprising the steps of:

(I) providing a first rail member with a first rail opening;

(II) attaching a first locking insert to the first rail opening of the first rail member; and then (III) pouring a material into a channel mold to provide a channel form with a first form sidewall and a second form sidewall with the first rail member and the first locking insert being a separate component embedded within the first form sidewall of the channel form; and then (IV) solidifying the channel form into a solid channel body including a first solid sidewall and a second solid sidewall such that the first rail member and the first locking insert are integrally embedded within the first solid sidewall.

16. The method of claim 15, wherein the material of step (III) comprises a concrete mixture.

17. The method of claim 15, wherein the step (II) of attaching comprises interlocking the first locking insert with the first rail opening of the first rail member.

18. The method of claim 15, further comprising a step (V) of rotating a locking bar between an unlocked position in which an end of the locking bar is not inserted in a first insert opening of the first locking insert, and a locked position in which the end of the locking bar is positioned within the first insert opening of the first locking insert.

19. The method of claim 18, further comprising a step (VI) of positioning a cover to extend across an opening of an interior area of the solid channel body and to be supported at least partially by a first seat of the first rail member in a seated position.

20. The method of claim 19, further comprising the step (VII) of attaching the cover to the locking bar such that the cover is locked relative to the first rail member in the seated position.

* * * * *